US005942176A

United States Patent [19]

Fujii et al.

[11] Patent Number: 5,942,176

[45] Date of Patent: Aug. 24, 1999

[54] METHODS OF AND AGENTS FOR LUBRICATING SYNTHETIC FIBERS

[75] Inventors: Tsukasa Fujii; Michiharu Nagai; Yukio Komatsu; Yasushi Maeshima, all of Aichi, Japan

[73] Assignee: Takemoto Yushi Kabushiki Kaisha, Aichi, Japan

[21] Appl. No.: 08/996,114

[22] Filed: Dec. 22, 1997

[30] Foreign Application Priority Data

Jan. 14, 1997 [JP] Japan ..... 9-017584

[51] Int. Cl.[6] ..... D06M 15/507

[52] U.S. Cl. ..... 264/130; 524/315; 524/318; 525/408; 525/450; 528/354; 528/361; 528/366; 252/8.84; 8/115.6

[58] Field of Search ..... 525/408, 450; 528/354, 361, 366; 524/318, 315; 252/8.84; 264/130; 8/115.6

[56] References Cited

U.S. PATENT DOCUMENTS

| | | | |
|---|---|---|---|
| 2,917,410 | 12/1959 | Vitalis | 528/354 |
| 3,312,753 | 4/1967 | Bailey | 525/408 |
| 5,442,016 | 8/1995 | Jarrett | 525/415 |
| 5,525,702 | 6/1996 | Nace | 528/354 |

*Primary Examiner*—Patricia A. Short
*Attorney, Agent, or Firm*—Majestic, Parsons, Siebert & Hsue P.C.

[57] ABSTRACT

Synthtic fibers can be effectively lubricated by applying a lubricant containing polyether polyester block copolymer shown as follows:

$$(R^1(OC_5H_{10}\overset{\overset{O}{\|}}{C})_a - (OY^1\overset{\overset{O}{\|}}{C})_b - (OA^1)_cO\rightarrow_p X - Z_q$$

where X, Z, $A^1$, $Y^1$, and $R^1$ are each of a specified structure and integers a, b, c, p and q satisfy certain conditions.

12 Claims, No Drawings

METHODS OF AND AGENTS FOR LUBRICATING SYNTHETIC FIBERS

BACKGROUND OF THE INVENTION

This invention relates to methods of and agents for lubricating synthetic fibers.

During the spinning process of synthetic fibers such as polyamide and polyester fibers, it is important to prevent generation of fuzz and cause occurrence of yarn breakages. Since synthetic fibers for industrial materials such as tire cords, seat belts and air bags are produced under severe conditions of high temperature and high contact pressure and are likely to generate fuzz and yarn breakages, it is particularly important with such fibers to prevent generation of fuzz and occurrence of yarn breakages. Agents for lubricating such synthetic fibers (herein referred to simply as the lubricants) are therefore required to be capable of providing sufficient lubricity even when they are undergoing a spinning process under a condition of high temperature and high contact pressure. This invention relates to lubricating agents which can respond to such a demand and also to methods of lubricating synthetic fibers.

Examples of prior art lubricant proposed for providing lubricity to synthetic fibers including when they are undergoing a spinning process include (1) polyester obtained from polyhydroxy compound and dibasic acid having its end closed with aliphatic alcohol, its alkylene oxide adduct or aliphatic carboxylic acid (Japanese Patent Publications Tokkai 3-871 and 5-339875), (2) polyoxyalkyleneglycol with average molecular weight greater than 1000 (Japanese Patent Publication Tokkai 6-158538), (3) alkylene oxide polymers of alkylamine or dialkylamine with average molecular weight 1000–20000 (Japanese Patent Publication Tokkai 6-228885), (4) metallic salt of phosphoro-dithioate such as zinc di (di n-butylphosphoro dithioate) (Japanese Patent Publication Tokkai 3-14671 and U.S. Pat. No. 5,269,950), and (5) silane compound containing mercapto group such as γ-mercaptopropyl trimethoxy silane (Japanese Patent Publication Tokkai 3-241073 and U.S. Pat. No. 5,269,950). These prior art lubricants cannot provide a high level of lubricity to synthetic fibers, however, and lubricity can be provided only to a very unsatisfactory level in the case of synthetic fibers as industrial materials adapted to be processed under a condition of high-temperature and high contact pressure such that the generation of fuzz and occurrence of yarn breakage cannot be adequately prevented. As hydrophilic agent for providing durability to polyolefin fibers, on the other hand, it has been known to use block copolymers obtained by ring-opening polymerization of aliphatic hydroxy compound with alkylene oxide and ϵ-caprolactone and having within the molecule polyether blocks comprising polyoxyalkylene units and polyester blocks comprising polyoxycaproyl units (Japanese Patent Publication Tokkai 8-226082) but lubricity cannot be provided to a sufficiently high level to synthetic fibers even if such block copolymers are used as lubricant and the generation of fuzz and occurrence of yarn breakage cannot be adequately prevented during their spinning process.

SUMMARY OF THE INVENTION

The problem to be overcome by the present invention is that prior art lubricants cannot provide lubricity to synthetic fibers to a sufficiently high degree and in particular in the case of industrial synthetic fibers adapted to be processed under conditions of high temperature and high contact pressure such that generation of fuzz and occurrence of yarn breakage could not be effectively prevented.

This invention is based on the discovery by the present inventors that polyether polyester block copolymers of a specified kind are effective lubricants.

DETAILED DESCRIPTION OF THE INVENTION

This invention relates to lubricants comprising polyether polyester block copolymer shown by Formula (1) given below:

Formula (1)

$$(R^1(OC_5H_{10}\overset{O}{\overset{\|}{C}})_a-(OY^1\overset{O}{\overset{\|}{C}})_b-(OA^1)_cO\rightarrow_p X-Z_q$$

where X is a residual group obtained by removing all hydroxyl groups from aliphatic hydroxy compound having 1–6 hydroxyl groups in the molecule, $A^1$ is alkylene group with 2–4 carbon atoms, $Y^1$ is divalent aliphatic hydrocarbon group with 7–23 carbon atoms, $R^1$ is H, alkanoyl group with 2–18 carbon atoms or alkenoyl group with 16–22 carbon atoms, a is an integer 2–50, b is an integer 1–5, c is an integer 4–100, p is an integer 1–6, q is an integer 0–2 such that $1 \leqq p+q \leqq 6$ and $p>q$, and Z is hydroxyl group or organic group shown by Formula (2) given below:

Formula (2)

$$R^2(OC_5H_{10}\overset{O}{\overset{\|}{C}})_d-(OY^2\overset{O}{\overset{\|}{C}})_e-(OA^2)_fO$$

where $A^2$ is alkylene group with 2–4 carbon atoms, $Y^2$ is divalent aliphatic hydrocarbon group with 7–23 carbon atoms, $R^2$ is H, alkanoyl group with 2–18 carbon atoms or alkenoyl group with 16–22 carbon atoms, d is an integer 0–50, e is an integer 0–5 and f is an integer 0–100 such that d, e and f are not all 0.

Polyether polyester block copolymers shown by Formula (1) are of a structure obtainable by using aliphatic hydroxy compound with monohydroxyl-hexahydroxyl groups as a starting material and combining polymer block with at least one polyether polyester block to hydroxyl groups of this hydroxy compound. It is to be noted that this polymer block is required to contain polyester block with subscript "a" comprising polyoxycaproyl, polyether block with subscript "c" comprising polyoxyalkylene and connecting group with subscript "b" comprising (poly)oxyalkanoyl for connecting the aforementioned polyester and polyether blocks.

Such a polyether polyester block copolymer can be obtained by (1) a reaction for forming polyether block by ring-opening polymerization of alkylene oxide against the hydroxyl groups of aliphatic hydroxy compound with monohydroxy-hexahydroxy groups, (2) a reaction for forming connecting groups by the reaction between the end hydroxyl groups of the generated polyether block and monohydroxy monocarboxylic acid, and (3) a reaction for forming polyester block by the ring-opening polymerization of ϵ-caprolactone with the end hydroxyl groups of these generated connecting groups.

Examples of the aforementioned aliphatic hydroxy compound include (1) aliphatic monohydric alcohols such as methanol, butanol, lauryl alcohol and stearyl alcohol, (2) aliphatic polyhydric (of valence 2–6, or dihydric-hexahydric) alcohols such as ethylene glycol, 1,4-butanediol, 1,6-hexanediol, glycerol, trimethylolpropane, pentaerythritol and sorbitol, and (3) hydroxycarboxylic acid esters such as glycerol triricinolate (castor oil) and glycerol trihydroxy carboxylic acid ester (hydrogenized castor oil). Preferable among them are aliphatic polyhydric (of valence 2–4, or dihydric-tetrahydric) alcohols and aforementioned hydroxy carboxylic acid esters of glycerol. Still more preferable are aliphatic trihydric alcohols.

Examples of oxyalkylene unit for forming polyether block comprising polyoxyalkylene include oxyethylene unit, oxypropylene unit and oxybutylene unit, as well as oxyalkylene unit which is their mixture. Preferable among the above are those containing oxyethylene unit as oxyalkylene unit by 50 mol % or more. Even more preferable are those of which the oxyalkylene units include only oxyethylene units.

The preferable repetition number of oxyalkylene units forming the polyether block is 4–100, and more preferably 8–50.

The aforementioned connection group comprising (poly) oxyalkanoyl group of the polyether polyester block copolymers may be formed by esterification reaction with the use of aliphatic monohydroxy monocarboxylic acid against the end hydroxyl groups connected to the aforementioned polyether block. Those of aliphatic monohydroxy monocarboxylic acids with 8–24 carbon atoms are used but ricinolic acid (castor oil aliphatic acid) and 12-hydroxy stearic acid (hydrogenized castor oil aliphatic acid) can be advantageously used. Preferable repetition numbers for the oxyalkanoyl units for the connecting group obtained by reacting such aliphatic monohydroxy monocarboxylic acid is 5 or less.

The polyester blocks contained in the polyether polyester block copolymer are formed by ring-opening addition polymerization of ϵ-caprolactone against the end hydroxyl groups connected to (poly)oxyalkanoyl group generated by the aforementioned reaction. Thus, the polyester blocks come to be formed with oxycaproyl units, and the repetition number of the oxycaproyl units is preferably 2–50 and more preferably 4–25.

The polyether polyester block copolymer according to this invention is characterized, as described above, as containing in its molecule at least one polymer block which is required to include polyether block, polyester block and connecting group which connects polyester block and polyether block. The end hydroxyl group of the aforementioned polyester block may be modified with acylation agent. Examples of acyl group formed by such an acylation agent include (1) alkanoyl groups with 2–18 carbon atoms such as acetyl group, hexanoyl group, octanoyl group, hexadecanoyl group and octadecanoyl group, and (2) alkenoyl groups with 16–22 carbon atoms such as hexadecenoyl group, eicocenoyl group and octadecenoyl group.

The polyether polyester block copolymer according to this invention includes in its molecule at least one polymer block shown in Formula (1) inside the parentheses with subscript "p" but may also include an organic group shown by symbol Z. Symbol Z stands for hydroxyl group or an organic group shown by Formula (2). Examples of such organic group include (1) those comprising polyether block, (2) those comprising polyester block, (3) those comprising connecting groups, and (4) those combining two from (1) through (3), which are included in the aforemention polymer block.

According to this invention, integers p and q (p+q representing the number of hydroxyl groups in the aliphatic hydroxy compound) must satisfy the relationships $1 \leqq p+q \leqq 6$ and $p>q$. Thus, p=1 if p+q=1, p=2 if p+q=2, p=2 or 3 if p+q=3, p=3 or 4 if p+q=4, p=3, 4 or 5 if p+q=5 and p=4, 5 or 6 if p+q=6. According to this invention, it is preferred from the point of view of the purpose of this invention that the fraction of the polymer blocks in the polyether polyester block copolymer be as high as possible. Thus, it is preferred that p+q=p, that is, q=0.

According to this invention, furthermore, it is preferred that the repetition number "a" in Formula (1) of the oxycaproyl units comprising the polyester block and the repetition number "c" of the oxyalkylene units comprising the polyether block be related as a/c=1/4–1/1. For the polyether polyester block copolymers adapted to provide adequate lubrication of synthetic fibers even under conditions of high temperature and high contact pressure, the average molecular weight is preferably 1000–20000 and more preferably 2000–10000.

The scope of this invention is not limited by the method of synthesizing the polyether polyester block copolymer of the kind described above. Any known prior art method may be used for the synthesis. The polyether blocks may be formed, for example, by causing ring-opening polymerization of aliphatic hydroxy compound with alkylene oxide sequentially in the presence of a basic catalyst. The connecting groups may be formed, for example, by esterifying or polyesterifying end hydroxyl groups of the polyether blocks formed as described above by reacting hydroxy carboxylic acid with them in the presence of an acidic catalyst. The polyester blocks may be formed, for example, by ring-opening addition polymerization of ϵ-caprolactone in the presence of a known catalyst for anion polymerization, cation polymerization or coordinated anion polymerization with end hydroxyl groups of the connecting group formed as described above. For the acylation of end hydroxyl groups of polyester blocks of the polyether polyester block copolymer, the known prior art method of reacting acyl halide may be used in the presence of a base.

A lubricant according to this invention may contain aliphatic ester in addition to polyether polyester block copolymer shown by Formula (1). This invention does not impose any particular limitation on the kind of such aliphatic esters which may be used according to this invention with polyether polyester block copolymer but preferred examples include oleic acid esters using oleic acid as aliphatic acid or oleyl alcohol ester using oleyl alcohol as an example of alcohol. Preferred examples of oleic acid ester include isopentacosyl oleate and 1,6-hexanediol dioleate. Preferred examples of oleyl alcohol ester include dioleyl adipate.

When aliphatic ester and polyether polyester block copolymer are used together, the invention does no impose any particular limitation as to their ratio but a weight ratio in the range of (aliphatic ester)/(polyether polyester block copolymer)=50/50–95/5 is preferred.

When a lubricant according to this invention is applied to synthetic fibers, it is heated to 40–80° C. to make it into a uniform liquid and applied in the neat condition at a rate of 0.1–3.0 weight % with respect to the synthetic fibers. For causing the lubricant according to this invention to adhere to synthetic fibers, known prior art lubricating methods may be used such as the roller oiling method, the guide oiling method and the spray oiling method.

Examples of synthetic fibers to which the lubricants according to this invention can be applied include polyamide filaments, polyester filaments, polyacrylonitrile filaments and polyolefin filaments but it is preferred to apply them to polyamide or polyester filaments. It is particularly preferable to make the application between the spinning process and the drawing process.

Several preferred examples of lubricant will be described next as follows:

(1) Polyether polyester block copolymer (P-1) with molecular weight 3900 having within its molecule three polymer blocks comprised of polyether block with 30 oxyethylene units, connecting group with one oxyoctadecenoyl unit and polyester block with 5 oxycaproyl units, the aliphatic hydroxy compound serving as the starting material being glycerol;

(2) Polyether polyester block copolymer (P-2) with molecular weight 9200 having within its molecule three polymer blocks comprised of polyether block with 25 oxyethylene units and 5 oxypropylene units, connecting group with two oxyoctadecanoyl units and polyester block with 10 oxycaproyl units, the aliphatic hydroxy compound serving as the starting material being glycerol;

(3) Polyether polyester block copolymer (P-3) with molecular weight 5300 having within its molecule two polymer blocks comprised of polyether block with 30 oxyethylene units, connecting group with one oxyoctadecanoyl unit and polyester block with 10 oxycaproyl units, the aliphatic hydroxy compound serving as the starting material being ethylene glycol;

(4) Polyether polyester block copolymer (P-4) with molecular weight 8000 having within its molecule three polymer block comprised of polyether block with 15 oxyethylene units, connecting group with two oxyoctadecanoyl unit and polyester block with 10 oxycaproyl units, the aliphatic hydroxy compound serving as the starting material being glyceryl tri-12-hydroxystearate;

(5) Polyether polyester block copolymer (P-5) with molecular weight 4700 which is the same as (P-1) except the end hydroxyl groups of the polyester block in the polymer block are modified by acylation agent; and (6) Polyether polyester block copolymer (P-6) with molecular weight 3600 having the same two polymer blocks as (P-1) and one organic group formed with polyether block with 30 oxyethylene units and polyester block with 5 oxycaproyl units, the aliphatic hydroxy compound serving as the starting material being glycerol.

Preferred methods according to this invention of lubricating synthetic fibers include heating a lubricant according to any of (1)–(6) described above to 60° C. to make it a uniform liquid and applying it in the neat condition by the guide oiling method onto polyester fibers immediately after their spinning process at the rate of 1.0 weight %.

The invention is described next by way of test examples for actual applications but these examples are not intended to limit the scope of the invention. Throughout hereafter, "parts" will mean "weight parts" and "%" will mean "weight %".

Test Part No. 1 (Synthesis of polyether polyester block copolymers)

To synthesize polyether polyester block copolymer (P-1), glycerol 92 g (1 mole) and potassium hydroxide 2 g were placed inside an autoclave and after it was purged with nitrogen gas, ethylene oxide 1320 g (30 moles) was pressured in while the temperature was kept at 120–140° C. After one hour's maturation reaction, the catalyst was removed to obtain a reaction product which was a polyether compound with average repetition number of oxyethylene unit per hydroxyl group of glycerol 10 moles (by NMR method of analysis throughout herein), hydroxyl value 120, and average molecular weight 1400 (by GPC method, converted to polystyrene, throughout herein). This polyether compound 280 g (0.2 moles), ricinoleic acid 179 g (0.6 moles) and hydrate of paratoluene sulfonic acid 3 g were placed inside a flask and heated to 120–130° C. with stirring in the presence of a nitrogen gas flow. A reaction product was obtained by continuing the reaction for 2 hours while removing water being generated at the same temperature under a reduced pressure condition. This reaction product was an ester compound with hydroxyl value 76 and average molecular weight 2200, having each of the end hydroxyl groups of a polyether compound esterified by ricinoleic acid. This ester compound 220 g (0.1 mole) and tetrabutoxy titanate 1 g were placed inside a flask and heated to 150° C. with stirring in the presence of a nitrogen gas flow. While the temperature was maintained at 140–150° C., ϵ-caprolactone 171 g (1.5 moles) was dropped in over a period of 20 minutes. After this titration process, the reaction was continued for 3 hours at 150° C. to complete the synthesis and to obtain a synthesized object, which was polyether polyester block copolymer (P-1) with average molecular weight 3900 having three polymer blocks with an average of 10 oxyalkylene units, one oxyoctadecenoyl unit and an average of 5 oxycaproyl units.

Polyether polyester block copolymers (P-2)–(P-4) and (R-1)–(R-3) were obtained similarly, the details being shown in Table 1 below.

Polyether polyester block copolymer (P-5) was obtained as follows. Polyether polyester block copolymer (P-1) 390 parts (0.1 mole) and triethylamine 35 parts (0.35 moles) were added to 1 liter of toluene, heated and dissolved. Stearoyl chloride 100 parts (0.33 moles) was added to it gradually to cause a reaction which was completed by maintaining the reacting system at 50–60° C. for two hours. After the completion of the reaction, extracted triethylamine salt was filtered, and toluene was distilled away under a reduced pressure condition from the filtered liquid to obtain polyether polyester block copolymer (P-5) with average molecular weight 4700 having the end hydroxyl groups of polyester block acylated.

Polyether polyester block copolymer (P-6) was obtained as polyether polyester block copolymer (P-1) was synthesized except that 119 parts (0.4 moles) of ricinoleic acid were caused to react with 280 parts of the polyether compound obtained during the synthesis of polyether polyester block copolymer (P-1). Polyether polyester block copolymer (P-6) thus obtained had two polymer blocks comprising the same polyether blocks, connecting block and polyester blocks as polyether polyester block copolymer (P-1) and one organic group comprising polyether and polyester blocks.

Acylated polyether (R-4) was obtained by reacting 299 parts (0.99 moles) of stearoyl chloride against 420 parts (0.3 moles) of polyether having an average of 10 oxyethylene units connected to each hydroxyl group of glycerol as in the aforementioned synthesis of polyether polyester block copolymer (P-5).

Acylated polyester (R-5) was obtained by reacting 100 parts (0.33 moles) of stearoyl chloride against 350 parts (0.1 mole) of polyester triol having an average of 10 oxycaproyl units connected to each hydroxyl group of glycerol as in the aforementioned synthesis of polyether polyester block copolymer (P-5).

The above is summarized in Table 1 below.

TABLE 1

| Polyether polyester block copolymer | Residual group of aliphatic hydric compound: Kind of aliphatic hydric compound | p + q | Polymer block: Polyether block: Kind | c |
|---|---|---|---|---|
| P-1 | Glycerol | 3 | PE-1 | 10 |
| P-2 | Glycerol | 3 | PE-2 | 30 |
| P-3 | Ethylene glycol | 2 | PE-1 | 30 |
| P-4 | GTS | 3 | PE-1 | 15 |
| P-5 | Glycerol | 3 | PE-1 | 10 |
| P-6 | Glycerol | 3 | PE-1 | 10 |
| R-1 | Glycerol | 3 | PE-1 | 2 |
| R-2 | Glycerol | 3 | PE-1 | 150 |
| R-3 | Glycerol | 3 | PE-1 | 150 |
| R-4 | Glycerol | 3 | PE-1 | 30 |
| R-5 | Glycerol | 3 | — | — |

| Polymer block: Connecting group: Kind | b | a | $R^1$ | p | a/c | Organic group of Formula (2): Z | q | Average Molecular Weight |
|---|---|---|---|---|---|---|---|---|
| A-1 | 1 | 5 | H | 3 | 1/2 | — | 0 | 3900 |
| A-2 | 2 | 10 | H | 3 | 1/3 | — | 0 | 9200 |
| A-2 | 1 | 10 | H | 2 | 1/3 | — | 0 | 5300 |
| A-2 | 2 | 10 | H | 3 | 2/3 | — | 0 | 8000 |
| A-1 | 1 | 5 | AC | 3 | 1/2 | — | 0 | 4700 |
| A-1 | 1 | 5 | H | 2 | 1/2 | Z-1 | 1 | 3600 |
| A-1 | 1 | 2 | H | 3 | 1/1 | — | 0 | 1800 |
| A-2 | 1 | 10 | H | 3 | 1/15 | — | 0 | 10800 |
| A-1 | 1 | 60 | H | 3 | 6/1 | — | 0 | 27900 |
| — | — | — | AC | 3 | 0 | — | 0 | 2200 |
| — | — | 10 | AC | 3 | — | — | 0 | 4300 |

In Table 1:

PE-1: Polyoxyalkylene with only oxyethylene units;

PE-2: Polyoxyalkylene with (oxyethylene units)/(oxypropylene units)=25/5 in molar ratio;

A-1: Oxyoctadecenoyl unit;

A-2: Oxyoctadecanoyl unit;

AC: Stearoyl unit;

GTS: Glycerol tri-12-hydroxystearate;

Z-1: Organic group comprising polyether blocks with 30 oxyethylene units and polyester blocks with 5 oxycaproyl units.

Test Part 2 (Preparation of lubricants)

Preparation of Lubricants (T-1)–(T-6) and (t-1)–(t-5)

Polyether polyester block copolymers, acylated polyether and acylated polyester were used as lubricants as they were.

Preparation of Lubricants (T-7)–(T-9)

Lubricant (T-7) was prepared by mixing 10 parts of polyether polyester block copolymer (P-1) obtained in Test Part 1 and 90 parts of isopentacocyl oleate (E-1) at 70–80° C. until they became uniform. Lubricants (T-8) and (T-9) were similarly prepared, the details of the above being shown in Table 2 below.

Test Part 3 (Application of Lubricants)

Chips of polyethylene terephthalate with intrinsic viscosity 1.10 and carboxyl end group value 15 (equivalents of COOH/$10^6$ g polyethylene terephthalate) were melted and fibers were produced by means of an extruder with the use of spinneret with 500 holes. After the lubricants shown in Table 2 were heated to 60° C. and applied by the guide oiling method by the use of a measuring pump on the fibers from the spinneret, these fibers having the lubricant attached thereon were collected by means of a guiding means. After they were pulled by a draft roll with surface velocity of 3500 m/minute, they were drawn through a first drawing roll, a second drawing roll, a third drawing roll and a relaxing roll such that the total draw ratio would be 1.7. The fineness of the fibers after passing over the relaxing roll was 1500 denier. They were then wound up in the form of a wound cheese of 10 kg to obtain processed synthetic fibers.

Amounts of lubricants attached to the fibers were measured according to JIS-L1073 (Test method of synthetic fiber filaments) by using a mixed solvent of (normal hexane)/(ethanol)=50/50 (in volume ratio) as extraction solvent. The results are shown in Table 2.

The number of yarn breakages per ton of the synthetic fibers was measured and the measured values were evaluated according to the following standard:

A: Yarn breakages less than 0.5 times

B-A: Yarn breakages between 0.5 and 1.0 times

B: Yarn breakages between 1.0 and 1.5 times

C: Yarn breakages between 1.5 and 2.0 times

D: Yarn breakages over 2.0 times

The results are shown in Table 2.

The number of surface fuzz of 100 cheeses of the 10 kg wound cheese of the processed synthetic fibers and the measured numbers were evaluated according to the following standard:

A: Less than 50

B-A: Between 50 and 200

B: Between 200 and 500

C: Between 500 and 1000

D: Over 1000

The results are shown in Table 2.

TABLE 2

| | Lubricant: Kind | Polyether polyester copolymer: Kind | Amount | Aliphatic acid ester: Kind | Amount |
|---|---|---|---|---|---|
| Test Examples | | | | | |
| 1 | T-1 | P-1 | 100 | — | — |
| 2 | T-2 | P-2 | 100 | — | — |
| 3 | T-3 | P-3 | 100 | — | — |
| 4 | T-4 | P-4 | 100 | — | — |
| 5 | T-5 | P-5 | 100 | — | — |
| 6 | T-6 | P-6 | 100 | — | — |
| 7 | T-7 | P-1 | 10 | E-1 | 90 |
| 8 | T-8 | P-2 | 20 | E-2 | 80 |
| 9 | T-9 | P-4 | 30 | E-3 | 70 |
| Comparison Examples | | | | | |
| 1 | t-1 | R-1 | 100 | — | — |
| 2 | t-2 | R-2 | 100 | — | — |
| 3 | t-3 | R-3 | 100 | — | — |
| 4 | t-4 | R-4 | 100 | — | — |
| 5 | t-5 | R-5 | 100 | — | — |
| 6 | t-6 | — | — | — | — |
| 7 | t-7 | — | — | — | — |
| 8 | t-8 | — | — | — | — |
| 9 | t-9 | — | — | — | — |

TABLE 2-continued

| Lubricant | | | | | |
|---|---|---|---|---|---|
| Others | | Aliphatic ester/polyether polyester copolymer | Attached amount | Yarn break- | |
| Kind | Amount | (weight) | (%) | age | Fuzz |
| — | — | — | 1.0 | B-A | B-A |
| — | — | — | 0.8 | B-A | B-A |
| — | — | — | 1.5 | B | B |
| — | — | — | 1.5 | B-A | B-A |
| — | — | — | 1.5 | B-A | B-A |
| — | — | — | 1.5 | B | B |
| — | — | 90/10 | 0.8 | A | A |
| — | — | 80/20 | 1.0 | A | A |
| — | — | 70/30 | 1.5 | A | A |
| — | — | — | 1.0 | D | C |
| — | — | — | 1.0 | D | C |
| — | — | — | 1.0 | D | C |
| — | — | — | 1.0 | D | D |
| — | — | — | 1.0 | D | D |
| R-6 | 100 | — | 1.0 | D | D |
| R-7 | 100 | — | 1.0 | D | D |
| R-8 | 100 | — | 1.0 | D | D |
| R-9 | 100 | — | 1.0 | D | D |

In Table 2:

E-1: Isopentacosyl oleate;

E-2: 1,6-hexanediol dioleate;

E-3: Dioleyl adipate;

R-6: Mixture of 33 parts of polyester with average molecular weight 6000 obtainable by polymerization reaction of (hydrogenized castor oil modified with ethylene oxide addition (oxyethylene repetition unit=25))/(adipic acid)/(dotriacontanoic acid)=2/1/2 (molar ratio) and 67 parts of hydrogenized castor oil modified with ethylene oxide adduct (oxyethylene repetition unit=25);

R-7: Mixture of 23 parts of polymer with average molecular weight 6000 obtainable by polymerization reaction of (hydrogenized castor oil modified with ethylene oxide addition (oxyethylene repetition unit=25))/(anhydrous maleic acid)/(stearic acid)=2/1/2 (molar ratio) and 77 parts of hydrogenized castor oil modified with ethylene oxide adduct (oxyethylene repetition unit=25);

R-8: Mixture of 23 parts of polyether copolymer with PO/EO=25/75 (molar ratio) and average molecular weight 8000 and 77 parts of hydrogenized castor oil modified with ethylene oxide adduct (oxyethylene repetition unit=25);

R-9: Mixture of 33 parts of lauryl amine modified with POP/POE addition with PO/EO=50/50 (molar ratio) and average molecular weight=5000 and 67 parts of hydrogenized castor oil modified with ethylene oxide adduct (oxyethylene repetition unit=25).

It has been clearly shown that this invention makes it possible to provide lubricity even to synthetic fibers produced under a condition of high temperature and high contact pressure and to obtain synthetic fibers which do not generate fuzz or cause yarn breakages even during their spinning process.

What is claimed is:

1. A lubricant of synthetic fibers, said lubricant comprising polyether polyester block copolymer shown by Formula (1) given below:

Formula (1)

$$(R^1(OC_5H_{10}\overset{\overset{O}{\|}}{C})_a-(OY^1\overset{\overset{O}{\|}}{C})_b-(OA^1)_cO\rightarrow_p X-Z_q$$

where X is a residual group obtained by removing all hydroxyl groups from aliphatic hydroxy compound having 1–6 hydroxyl groups in the molecule, $A^1$ is alkylene group with 2–4 carbon atoms, $Y^1$ is divalent aliphatic hydrocarbon group with 7–23 carbon atoms, $R^1$ is H, alkanoyl group with 2–18 carbon atoms or alkenoyl group with 16–22 carbon atoms, a is an integer 2–50, b is an integer 1–5, c is an integer 4–100, p is an integer 1–6, q is an integer 0–2 such that $1 \leqq p+q \leqq 6$ and p>q, and Z is hydroxyl group or organic group shown by Formula (2) given below:

Formula (2)

$$R^2(OC_5H_{10}\overset{\overset{O}{\|}}{C})_d-(OY^2\overset{\overset{O}{\|}}{C})_e-(OA^2)_fO$$

where $A^2$ is alkylene group with 2–4 carbon atoms, $Y^2$ is divalent aliphatic hydrocarbon group with 7–23 carbon atoms, $R^2$ is H, alkanoyl group with 2–18 carbon atoms or alkenoyl group with 16–22 carbon atoms, d is an integer 0–50, e is an integer 0–5 and f is an integer 0–100 such that d, e and f are not all 0.

2. The lubricant of claim 1 wherein X in said Formula (1) is a residual group obtainable by removing all hydroxyl groups from aliphatic dihydric-tetrahydric alcohol and q=0.

3. The lubricant of claim 1 wherein X in said Formula (1) is a residual group obtainable by removing all hydroxyl groups from glyceryl tri(hydroxystearate) or glyceryl triricinolate and q=0.

4. The lubricant of claim 1 wherein $$(OY^1\overset{\overset{O}{\|}}{C})$$

in said Formula (1) is (poly)oxyoctadecanoyl group or (poly)oxyoctadecenoyl group.

5. The lubricant of claim 1 wherein a/c in said Formula (1) is 1/4–1/1.

6. A lubricant of synthetic fibers, said lubricant containing polyether polyester block copolymer and one or more aliphatic acid esters selected from the group consisting of oleic acid esters and oleyl alcohol esters at weight ratio (said aliphatic acid esters)/(said polyether polyester block copolymer) of 50/50–95/5, said polyether polyester block copolymer being shown by Formula (1) given below:

Formula (1)

$$(R^1(OC_5H_{10}\overset{\overset{O}{\|}}{C})_a-(OY^1\overset{\overset{O}{\|}}{C})_b-(OA^1)_cO\rightarrow_p X-Z_q$$

where X is a residual group obtained by removing all hydroxyl groups from aliphatic hydroxy compound having 1–6 hydroxyl groups in the molecule, $A^1$ is alkylene group with 2–4 carbon atoms, $Y^1$ is divalent aliphatic hydrocarbon group with 7–23 carbon atoms, $R^1$ is H, alkanoyl group with 2–18 carbon atoms or alkenoyl group with 16–22 carbon atoms, a is an integer 2–50, b is an integer 1–5, c is an integer 4–100, p is an integer 1–6, q is an integer 0–2 such that $1 \leqq p+q \leqq 6$ and $p>q$, and Z is hydroxyl group or organic group shown by Formula (2) given below:

Formula (2)

$$R^2(OC_5H_{10}\overset{\overset{\displaystyle O}{\|}}{C})_d-(OY^2\overset{\overset{\displaystyle O}{\|}}{C})_e-(OA^2)_fO$$

where $A^2$ is alkylene group with 2–4 carbon atoms, $Y^2$ is divalent aliphatic hydrocarbon group with 7–23 carbon atoms, $R^2$ is H, alkanoyl group with 2–18 carbon atoms or alkenoyl group with 16–22 carbon atoms, d is an integer 0–50, e is an integer 0–5 and f is an integer 0–100 such that d, e and f are not all 0.

7. A method of lubricating synthetic fibers, said method comprising the steps of heating a lubricant to 40–80° C. and applying said heated lubricant in a neat condition onto said synthetic fibers at a rate of 0.1–3 weight % between spinning and drawings processes for said synthetic fibers, said lubricant containing polyether polyester block copolymer shown by Formula (1) given below:

Formula (1)

$$(R^1(OC_5H_{10}\overset{\overset{\displaystyle O}{\|}}{C})_a-(OY^1\overset{\overset{\displaystyle O}{\|}}{C})_b-(OA^1)_cO\rangle_p X-Z_q$$

where X is a residual group obtained by removing all hydroxyl groups from aliphatic hydroxy compound having 1–6 hydroxyl groups in the molecule, $A^1$ is alkylene group with 2–4 carbon atoms, $Y^1$ is divalent aliphatic hydrocarbon group with 7–23 carbon atoms, $R^1$ is H, alkanoyl group with 2–18 carbon atoms or alkenoyl group with 16–22 carbon atoms, a is an integer 2–50, b is an integer 1–5, c is an integer 4–100, p is an integer 1–6, q is an integer 0–2 such that $1 \leqq p+q \leqq 6$ and $p>q$, and Z is hydroxyl group or organic group shown by Formula (2) given below:

Formula (2)

$$R^2(OC_5H_{10}\overset{\overset{\displaystyle O}{\|}}{C})_d-(OY^2\overset{\overset{\displaystyle O}{\|}}{C})_e-(OA^2)_fO$$

where $A^2$ is alkylene group with 2–4 carbon atoms, $Y^2$ is divalent aliphatic hydrocarbon group with 7–23 carbon atoms, $R^2$ is H, alkanoyl group with 2–18 carbon atoms or alkenoyl group with 16–22 carbon atoms, d is an integer 0–50, e is an integer 0–5 and f is an integer 0–100 such that d, e and f are not all 0.

8. The method of claim 7 wherein X in said Formula (1) is a residual group obtainable by removing all hydroxyl groups from aliphatic dihydraic-tetrahydric alcohol and q=0.

9. The method of claim 7 wherein X in said Formula (1) is a residual group obtainable by removing all hydroxyl groups from glyceryl tri(hydroxystearate) or glyceryl triricinolate and q=0.

10. The method of claim 7 wherein $$(OY^1\overset{\overset{\displaystyle O}{\|}}{C})$$

in said Formula (1) is (poly)oxyoctadecanoyl group or (poly)oxyoctadecenoyl group.

11. The method of claim 7 wherein a/c in said Formula (1) is 1/4–1/1.

12. The method of claim 7 wherein said lubricant further containing one or more aliphatic acid esters selected from the group consisting of oleic acid esters and oleyl alcohol esters at weight ratio (said aliphatic acid esters)/(said polyether polyester block copolymer) of 50/50–95/5.

* * * * *